US005446254A

United States Patent [19]

Ritter et al.

[11] Patent Number: 5,446,254

[45] Date of Patent: Aug. 29, 1995

[54] PROCESS AND INSTALLATION FOR PRODUCING REINFORCEMENT WIRE MESHES

[75] Inventors: Klaus Ritter; Gerhard Ritter, both of Graz, Austria

[73] Assignee: EVG Entwicklungs- u. Verwertungs-Gesellschaft m.b.H., Raaba, Austria

[21] Appl. No.: 133,004

[22] PCT Filed: Feb. 3, 1993

[86] PCT No.: PCT/AT93/00013

§ 371 Date: Oct. 6, 1993

§ 102(e) Date: Oct. 6, 1993

[87] PCT Pub. No.: WO93/16825

PCT Pub. Date: Sep. 2, 1993

[30] Foreign Application Priority Data

Feb. 20, 1992 [AT] Austria ..... 316/92

[51] Int. Cl.[6] ..... B21F 27/14; B21F 27/10; B23K 11/10

[52] U.S. Cl. ..... 219/56; 140/112

[58] Field of Search ..... 219/56, 57, 58; 140/112

[56] References Cited

U.S. PATENT DOCUMENTS

| | | | |
|---|---|---|---|
| 1,390,293 | 9/1921 | Johnson | 140/112 |
| 1,961,991 | 6/1934 | Southwell | 140/112 |
| 2,278,104 | 3/1942 | Harter | 219/56 |
| 3,286,072 | 11/1966 | Ritter et al. | 219/56 |
| 3,578,934 | 5/1971 | Beauvais . | |
| 3,602,269 | 8/1971 | Gott et al. | 140/112 |
| 4,526,025 | 7/1985 | Ritter et al. | 72/388 |

FOREIGN PATENT DOCUMENTS

| | | | |
|---|---|---|---|
| 185205 | 4/1956 | Austria . | |
| 373513 | 1/1984 | Austria . | |
| 0101675 | 2/1984 | European Pat. Off. . | |
| 3741372 | 11/1988 | Germany | 140/112 |
| 1314753 | 4/1973 | United Kingdom | 140/112 |
| 1297977 | 3/1987 | U.S.S.R. | 140/112 |

*Primary Examiner*—Geoffrey S. Evans
*Attorney, Agent, or Firm*—Frishauf, Holtz, Goodman & Woodward

[57] ABSTRACT

A process and installation for producing reinforcement wire meshes by welding longitudinal and transverse wires (L, Q) together at their crossing points, leaving ends (E) or the transverse wires projecting beyond the longitudinal edge wires using a continuous wire meshes welding machine, in which, in order to produce reinforcement wire meshes where at least one of the projecting ends or the transverse rods is bent back towards the longitudinal edge wire in the form or a loop and welded thereto, straight transverse wires are supplied, at least one of the ends in front of the weld line of the wire meshes welding machine is bent back in the form of a loop towards the longitudinal edge wire (L') and the loop end (S) is welded to the longitudinal edge wire in the weld line (C) at the same time as the longitudinal and transverse wires are welded together.

20 Claims, 2 Drawing Sheets

PROCESS AND INSTALLATION FOR PRODUCING REINFORCEMENT WIRE MESHES

FIELD OF THE INVENTION

The invention relates to a process and an installation for producing reinforced wire mesh from a number of longitudinal and transverse wires welded to each other at the crossing points of the mesh and having transverse wire end-pieces extending beyond longitudinal edge elements, wherein at least one of the projecting transverse wire end pieces is bent back in the mesh plane in the shape of a loop in respect to the longitudinal edge element and is welded to it, using a continuously operating wire mesh welding machine.

BACKGROUND

A process for producing reinforced wire mesh of the type recited hereinabove is known from Austrian Patent 373 513, wherein prefabricated transverse wires with end pieces bent back in the shape of loops are supplied to wire mesh welding machine, which requires additional manufacturing efforts because of the bent transverse wire ends, the transverse wires are difficult to handle or to store in a storage warehouse.

THE INVENTION

It is an object of the invention to provide a process and an apparatus which make it possible to produce reinforced wire mesh of the type recited hereinabove in a continuous production method. In accordance with a feature of the invention straight transverse wires are conveyed, then at least one of the transverse wire end pieces projecting beyond the longitudinal edge elements is bent back in the form of a loop in respect to longitudinal edge element ahead of the weld line of the wire mesh welding machine. The looped end is subsequently welded to the longitudinal edge element simultaneously with the welding of the longitudinal and transverse wires.

The invention makes it possible in a simple manner to produce so-called loop mesh in a continuously operating production process. All mentioned disadvantages of the known process are avoided by means of the process in accordance with the invention. The production capacity is increased at the same time.

In accordance with a feature of the invention, the straight transverse wires are separated from a stock and conveyed to the wire mesh welding machine. In accordance with another characteristic of the invention which can be employed alternatively or additionally, the wire is drawn off a supply card, straightened and conveyed crosswise to the longitudinal wire feed path, after which the wire is cut to length to form respectively one transverse wire.

The apparatus to carry out the process has a device for conveying longitudinal wires and longitudinal edge elements along a longitudinal wire feed path, a device for conveying transverse wires, previously cut to length, from stock in the direction of the longitudinal wire feed path and/or a device for conveying transverse wire from a supply crosswise to the longitudinal wire feed path and for cutting individual transverse wires to length. A resistance welding device welds the transverse wires to the longitudinal wires; In accordance with another feature of the invention. The apparatus has a device for bending at least one of transverse wire end pieces projecting beyond the longitudinal edge pieces into a loop, which is placed downstream in the longitudinal wire feed direction of the transverse wire conveying device; a device for conveying the transverse wires, provided with a loop, to the resistance welding device is associated with this loop-bending device, and the resistance welding device has a welding head in the area of at least one of the longitudinal edge elements for welding the associated bent-back loop end to the longitudinal edge element.

Preferably, one loop-bending device per wire mesh edge is provided wherein in accordance with another characteristic of the invention the loop-bending device is displaceable in the longitudinal wire feed direction for the purpose of changing the direction of the bend.

In accordance with the invention, the loop-bending device has a rotatable bending plate with an eccentric bending mandrel and, located opposite the bending plate, a central bending template which can be preferably retracted from its operating position into a rest position perpendicularly to the longitudinal wire feed path, which clears the movement path of the transverse wire and the transverse wire loops. It is alternately or additionally also possible to retract the bending plate or the bending tool from a working position into a rest position which clears the movement path of the transverse wire and the transverse wire loops.

In accordance with another characteristic of the invention, each loop welding head is displaceable in the longitudinal wire feed direction, so as to be adaptable to various loop sizes.

To increase safety and accuracy of production, the transfer device suitably has clamping cheeks which maintain the transverse wires in the loop-bending device during bending and are simultaneously used for transferring the transverse wires into the welding device.

It is possible within the scope of the invention to provide each loop welding head, together with an edge welding head, with welding current in accordance with the double spot welding method.

Further characteristics of the invention will be explained in detail by means of an exemplary embodiment, making reference to the drawings.

DRAWINGS

Figure 1:
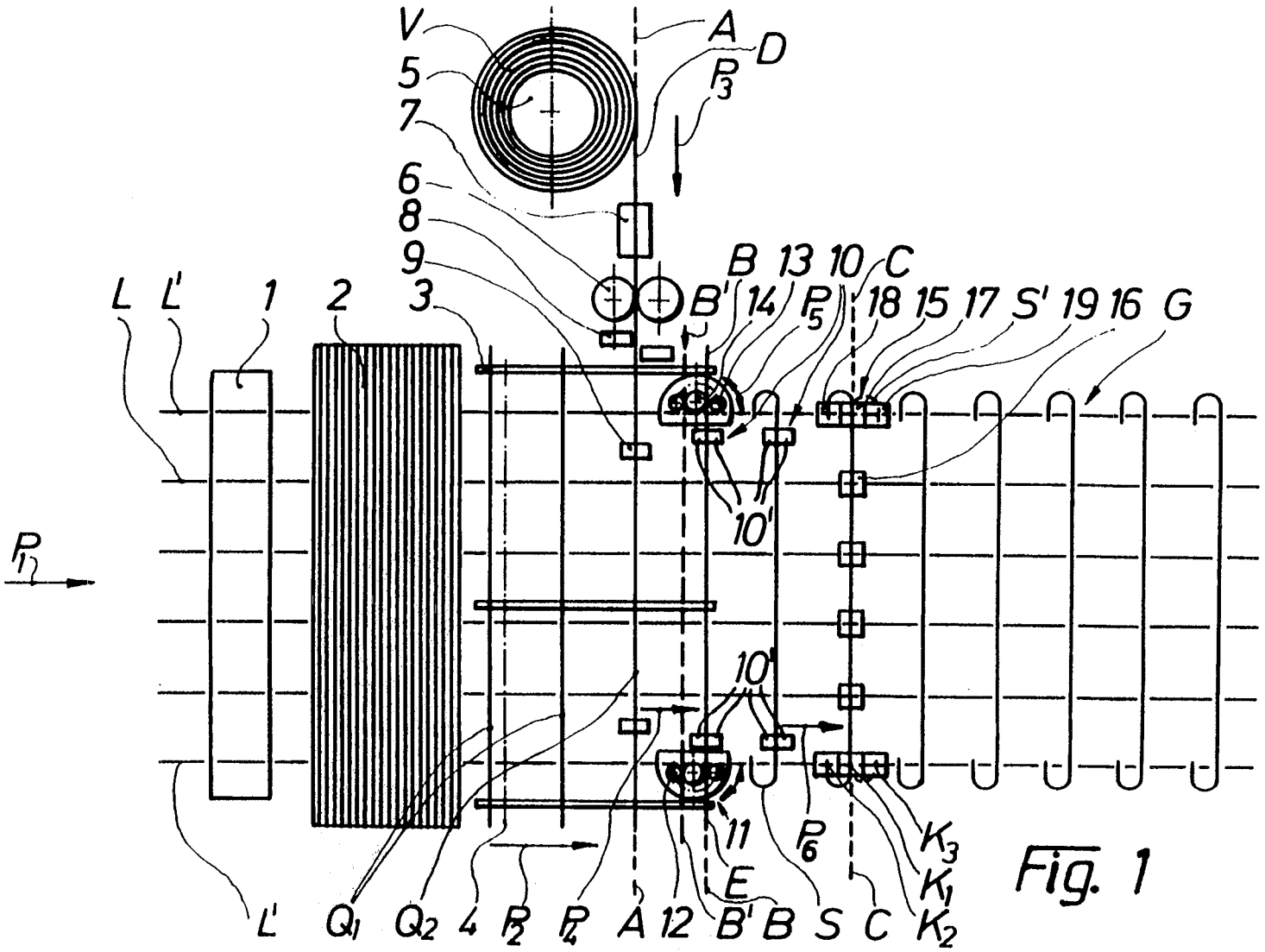
FIG. 1 shows an installation in accordance with the invention in a schematic top view.

A plurality of longitudinal wires L are conveyed in the direction of the arrow P along a horizontal feed path to a bending and welding installation with the aid of a feed device 1. The longitudinal wires have distances from each other which are selected in accordance with the required mesh size of the wire mesh G to be produced. A longitudinal edge wire L′ is respectively disposed at both lateral edges of the number of longitudinal wires L, the diameter of which is either equal to the diameter of the longitudinal wires L in the interior wire mesh area or which can be different. The diameter of the longitudinal edge wires L′ is preferably selected to be less than the diameter of the longitudinal wires L in the interior wire mesh area.

Transverse wires $Q_1$, cut to length and straightened, are individually transferred to a Conveying device 3, shown only schematically, from a reservoir 2, preferably disposed above the number of longitudinal wires L. For example, the conveying device 3 consists of circulating conveyor chains driven by a powered shaft 4, which convey the transverse wires $Q_1$ at a mutual distance from each other by means of carriers, not shown, in the direction of the arrow $P_2$ through a wire feed line A—A into bending lines B—B or B'—B' of the bending and welding installation of the invention. It is also possible within the scope of the invention to dispose the transverse wire reservoir 2 and the conveying device 3 below the plane of the number of longitudinal wires L, so that the transverse wires $Q_1$ can also be conveyed to the bending lines B—B or B'—B' below the longitudinal wires L, L'.

The drawings further show a reservoir coil 5 for a wire supply V, disposed on the side of the feed path of the longitudinal wires L. The wire D is drawn off the wire supply V with the aid of an injecting device 6, is straightened in a straightening device 7, is conveyed crosswise to the longitudinal wire feed direction in the direction of the arrow $P_3$ along a feed or injection line A—A and is subsequently cut to length from the supply by means of a cutting device 8 to form the transverse wire $Q_2$. Within the scope of the invention, the injection line A—A can extend above and/or below the number of longitudinal wires L, so that the transverse wires $Q_2$ can be arranged only above or only below or alternatingly above and below the number of longitudinal wires L.

Within the scope of the invention it is also possible to provide a second injection line disposed offset in the production direction $P_1$ in order to be able to convey another transverse wire laterally from a further reservoir coil with the aid of a further injection device, so that the productivity of the installation for a more rapidly operating welding device can be increased.

With the aid of an only schematically shown conveying device 9, the transverse wires $Q_2$ are brought into bending lines B—B or B'—B' in accordance with the arrow $P_4$. In the bending lines B—B or B'—B' the transverse wires $Q_1$ or $Q_2$ are grasped by the clamps or clamping jaws of a transfer device 10, also only shown schematically. The transverse wire end pieces E extending beyond the longitudinal edge wire L' are bent back into loops S or S' in the direction toward the longitudinal edge wire with the help of each one of a bending device 11 disposed on the side of the number of longitudinal wires L. Following the bending process, the transverse wires $Q_1$, $Q_2$ provided with loops are transferred with the aid of the transfer device 10 into the welding line C—C in accordance with the arrow $P_6$.

The bending device 11 is well known and has a bending plate 12, rotatable in accordance with the two-headed arrow $P_5$ and supporting an eccentrically disposed bending tool 13, which can be retracted from its working position perpendicularly to the longitudinal wire feed path into a rest position in the bending plate 12, in order to make the transfer of the transverse wires $Q_1$ or $Q_2$ into the welding line C—C possible with the aid of the transfer device 10. A central bending template 14 is located opposite it flush with the axis of the bending plate 12. The transverse wire end pieces E are bent around the template 14, which for this is shaped in accordance with the desired form of the transverse wire loops S or S'. The central bending template 14 can also be retracted from its working position perpendicularly to the longitudinal wire feed path into a rest position sufficiently far, so that the central bending template 14 no longer hampers the conveying movement of the transverse wires $Q_1$ or $Q_2$ from the injection line E—E into the bending line B—B, as well as the transfer movement of the transverse wires $Q_1$ or $Q_2$ from the bending lines B—B or B'—B' into the welding line C—C.

In accordance with a feature of the invention, the bending devices 11 are designed in such a way that it is possible to bend the transverse wire end pieces E into loops S opposite to the longitudinal wire feed direction $P_1$, as shown by solid lines in the drawings, as well as into loops S' in the longitudinal wire feed direction $P_1$, as shown by dashed lines in the drawing figure. The loop bending devices 11 can be displaceable in the longitudinal wire feed direction $P_1$ for the purpose of changing the direction of bending. However, it is also possible to keep the loop bending devices 11 stationary when changing the bending direction and to convey the straight transverse wires $Q_1$, $Q_2$ to the bending line B'—B' which, looking in the longitudinal wire direction $P_1$, is located ahead of the original bending line B—B and ahead of the central bending templates 14. It is further possible within the scope of the invention to bend the two loops S or S' with the aid of the two bending devices 11 in the same direction or in an opposite direction on a transverse wire, i.e. to bend one loop S of the transverse wire opposite the longitudinal wire feed direction $P_1$ and the other loop S' in the longitudinal wire feed direction $P_1$.

A resistance welding device 15 is provided in the welding line C—C, which is equipped with only schematically shown welding heads 16 for welding the transverse wires $Q_1$, $Q_2$ to all longitudinal wires L in the interior wire mesh area , and with two also only schematically shown edge welding heads 17 for welding the transverse wires $Q_1$, $Q_2$ to the two longitudinal edge wires L'. The welding device 15 can operate either in accordance with the double spot or the single spot welding method.

The inner welding heads 16 and the edge welding heads 17 respectively consist of an upper electrode **16*a*, 17*a* (FIGS. 1 and 4), disposed above the number of longitudinal wires L, and a lower electrode 16*b*, 17*b* disposed below the number of longitudinal wires L. The electrodes are provided with welding current in accordance with the welding method used and are electrically connected with each other accordingly. The upper electrodes and/or the lower electrodes of the inner welding heads 16 and the edge welding heads 17 can be raised and lowered perpendicularly to the longitudinal wire feed path, preferably together, in the cycle of the welding device 15, and can be charged with the required welding pressure. The edge welding heads 18, 19 are multiple units, moving and operating in conjunction with head 17**.

Two front loop welding heads 18 are provided for welding the loops S with ends bent over opposite to the longitudinal wire feed direction $P_1$ to the longitudinal edge wires L', and are disposed, looking in the longitudinal wire feed direction $P_1$, in front of the welding line C—C, are flush with the respective edge welding heads 17 and are displaceable in the longitudinal wire feed direction $P_1$ for the purpose of adaptation to the size of the loop S to be welded. For welding the loops S' with ends bent in the longitudinal wire feed direction $P_1$, two further rear loop welding heads 19 are provided which, looking in the longitudinal wire feed direction $P_1$, are located behind the welding line C—C, are also flush with the edge welding heads 17, and are also displaceable in the longitudinal wire feed direction $P_1$.

All loop welding heads 18, 19 consist of respectively one upper 18*a* and one lower electrode 18*b* which preferably can be raised and lowered together with the corresponding electrodes of the edge welding heads 17 in the cycle of the welding device 15.

Figure 2:
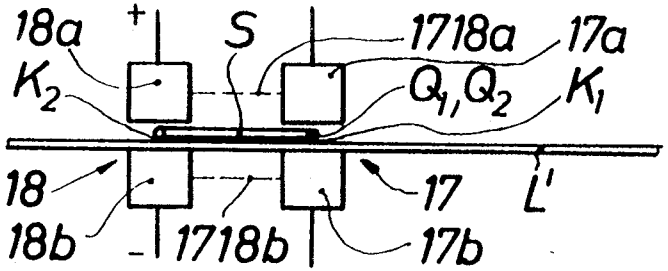
FIG. 2 is a schematic illustration of one welding circuit arrangement, illustrating the individual or single-spot circuitry.
Figure 3:
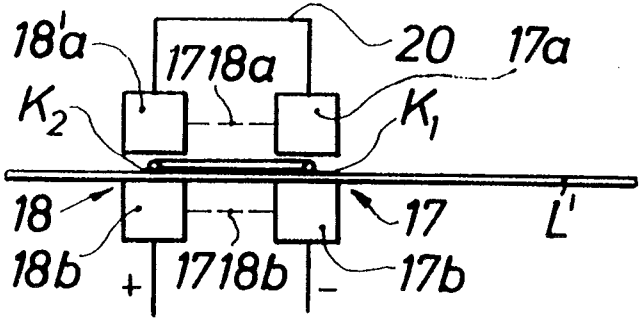
FIGS. 3 and 4 schematically show other embodiments of welding circuit arrangements, illustrating two embodiments of double-spot welding circuit arrangements.
Figure 4:
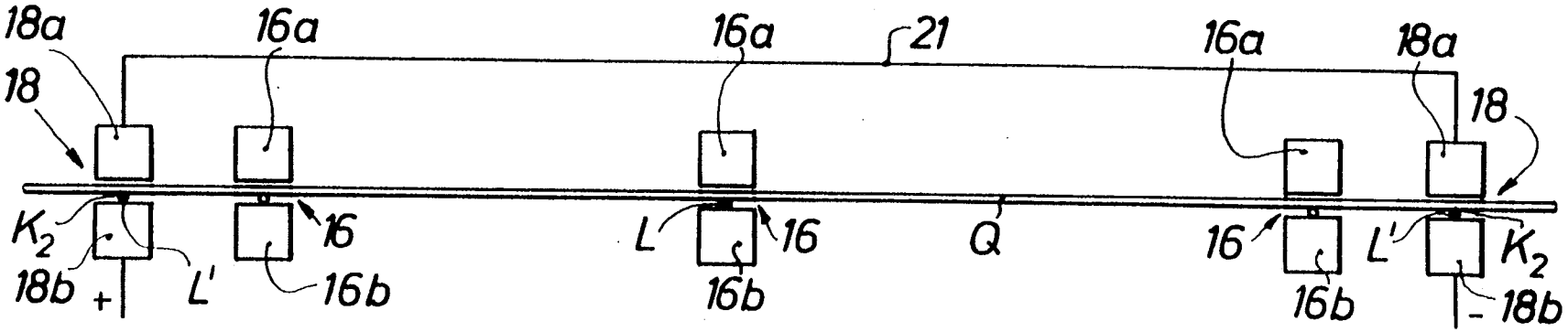

The following three possibilities are available for welding the loops S to the longitudinal edge wires L':

a) Each front loop welding head 18 is provided with its own current supply (see FIG. 2) and is mechanically coupled with the corresponding edge welding head, 17 only in respect to the common lift and lowering motion, as schematically shown by broken lines 1718*a* and 1718*b*, is completely electrically separated from it. Thus, welding is performed in accordance with the individual, or single spot welding method separately at each crossing point $K_2$, $K_1$, respectively formed between the end of the bent-over loop S and the longitudinal edge wire L' and respectively, the transverse wire $Q_1$, $Q_2$ and wire L1.

b) The loop welding head 18 and the edge welding head 17 are provided with a common current supply (see FIG. 3) at each wire mesh edge, thus they operate in accordance with the so-called double spot welding method. The two welding heads 18, 17 are mechanically coupled with each other in respect to the common lift and lowering motion, see lines 1718*a*, 1718*b*, but electrically separated from the inner welding heads 16. In this case the welding current flows, for example, from one terminal of the welding transformer first through the crossing point $K_1$, which is formed between the longitudinal edge wire L' and the transverse wire $Q_1$, $Q_2$, then across a current bridge 20 extending in the longitudinal wire direction $P_1$ and connecting the the two electrodes of the two welding heads 17 and 18, corresponding to each other and located on the same side of the number of longitudinal wires L, into the crossing point $K_2$ and finally back to the other terminal of the welding transformer.

c) The two front loop welding heads 18 are provided with a common welding current supply and also operate in accordance with the so-called double spot welding method, see FIG. 4. The two front loop welding heads 18 are mechanically connected with the edge welding heads 17 only in respect to the common lift and lowering motion, but electrically separated from them. The welding current flows, for example, from one terminal of the welding transformer first through the crossing point $K_2$ at one wire mesh edge, then across a current bridge 21 extending parallel to the weld line C—C, which connects the two electrodes 18C of the loop welding heads 18 located on the same side, then through the second crossing point $K_2$ at the other edge of the wire mesh, and finally back to the other terminal of the welding transformer.

The loops S' the ends of which are bent in the longitudinal wire feed direction $P_1$, are welded to the longitudinal edge wires L' by means of the loop welding heads 19 at the crossing points $K_3$ (FIG. 1) in an analogous manner to that described in connection with welding heads 18.

The selection of the optimal welding method essentially depends on the structure of the reinforced wire mesh to be produced, in particular on the distance of the longitudinal edge wires L' from the adjoining longitudinal wires L in the interior wire mesh area and on the proportion of the material thicknesses in the crossing points $K_1$, $K_2$, $K_3$ to the material thicknesses in the remaining crossing points along the welding line C—C in the interior wire mesh area.

It is understood that the invention is not limited to the exemplary embodiment disclosed, instead, it can be changed in different ways within the scope of the general invention concept. In particular, it is possible to provide a plurality of bending devices 11 at each edge of the number of longitudinal wires L for the simultaneous bending of a plurality of transverse wires, in which case the bending devices are disposed behind each other in the longitudinal wire feed direction $P_1$.

It is further possible within the scope of the invention, when producing reinforced wire mesh with respectively two closely adjoining longitudinal edge wires per mesh edge, which form the longitudinal edge element, to bend the loops as far as the inner one of the two longitudinal edge wires, to provide additional loop welding heads and to weld the loops to both or only one of the two longitudinal edge wires.

Within the scope of the invention, the loop bending device 11 can also consist of a bending plate 12 which, in addition to the eccentric bending tool 13, also supports the central bending template 14, in which case the bending plate 12 is again displaceable for the purpose of changing the bending direction in the longitudinal wire feed direction $P_1$.

It is furthermore possible within the scope of the invention, to form, by means of the bending and welding installation of the invention, the transverse wire end piece E only on one side of the transverse wire into a loop welded to the longitudinal wire and to leave the transverse wire piece E either straight on the other side of the same transverse wire or to provide it with a loop, an eye, an end hook bent in an L-shape or a similarly shaped end hook, which are respectively not welded to the longitudinal edge wire.

Finally, within the scope of the invention it is possible in a further process step to angle the loops S or S' out of the plane of the transverse wires in the direction of the plane of the longitudinal wires with the aid of a folding press following the welding device 15. When depositing non-rotated reinforced wire mesh and reinforced wire mesh G which has been rotated by 180° around its longitudinal axis on a stack, space-saving engagement of the number of longitudinal or transverse wires of adjoining reinforced wire mesh is made possible by the angled loops.

We claim:

1. A process for producing reinforced wire mesh from a number of longitudinal (L, L') and transverse ($Q_1$, $Q_2$) wires welded to each other at crossing points of the mesh and having transverse wire end pieces (E) extending beyond longitudinal edge elements, wherein at least one of the projecting transverse wire end pieces (E) is bent back in the mesh plane in the shape of a loop (S) with respect to the longitudinal edge elements and is welded to at least one of the longitudinal wires, using a continuously operating wire mesh welding machine, comprising the steps of conveying straight transverse wires ($Q_1$, $Q_2$) having said projecting end pieces (E) across said longitudinal wires (L, L') and locating said wires in a feed line (A—A);

then bending back at least one of the transverse wire end pieces (E) projecting beyond at least one of the longitudinal edge elements in the form of the loop (S) with respect to the longitudinal edge element at a bending line, located ahead of a welding line (C—C) of the wire mesh welding machine; and subsequently welding, at the welding line (C—C), the transverse wires ($Q_1$, $Q_2$) to the longitudinal wires (L, L'), as well as the end of the loop (S) to at least one of the longitudinal wires (L, L') and optionally to at least one edge element (L') of the longitudinal wires, simultaneously with the welding of the longitudinal and transverse wires; and wherein the welding line (C—C) and the feed line (A—A) are offset from each other in the direction of the longitudinal wires (L, L').

2. The process of claim 1, characterized in that the straight transverse wires ($Q_1$, $Q_2$) are separated from a supply and then conveyed to the wire mesh welding machine.

3. The process of claim 1, characterized in that the step of conveying transverse wires wire is drawn off a reel (V, 5), straightened and conveyed crosswise to the longitudinal wire feed path (P1), after which the wire is cut to length to form respectively one transverse wire.

4. The process of claim 1, wherein the bending-back step is carried out at a bending line (B—B);

and further including conveying the transverse wires from the feed line (A—A) to the bending line (B—B), and then to the welding line.

5. An installation for producing reinforced wire mesh from a number of longitudinal (L, L') and transverse ($Q_1$, $Q_2$) wires comprising a device (1) for conveying and feeding the longitudinal wires (L, L'), two of which define longitudinal edge elements (L'), in a longitudinal wire feed direction along a wire feed path ($P_1$);

transverse wire conveying means for conveying the transverse wires ($Q_1$, $Q_2$) across said longitudinal wires, said transverse wires having at least one end piece (E) projecting at least at one side beyond a first longitudinal end element (L') of the longitudinal wires (L, L') and placing said transverse wires in a feed line (A—A), extending transversely to the direction of the longitudinal wire feed path; and a resistance welding device (15) for welding the transverse wires ($Q_1$, $Q_2$) to the longitudinal wires (L, L'), a bending device (11) for bending at least one of the transverse wire end pieces (E) projecting beyond the first longitudinal edge element (L') into a loop (S, S') located at a bending line (B—B) downstream of the feed line (A—A), in the longitudinal wire feed direction;

transverse wire positioning means (10) for moving the transverse wires ($Q_1$, $Q_2$), provided with the loop (S, S') to the resistance welding device (15), said resistance welding device (15) being located at a welding line (C—C) associated with said loop bending device (11); and wherein the resistance welding device (15) has a welding head (18, 19) in the area of at least one of the longitudinal edge elements (L') for welding the associated bent-back loop ends (S, S') to at least one of the longitudinal wires (L), and optionally to at least one longitudinal edge element (L').

6. The installation claim 5, characterized in that the loop bending device (11) is displaceable in the longitudinal wire feed direction ($P_1$) for the purpose of changing the bending direction.

7. The installation of one claim 5, characterized in that the loop-bending device (11) has a rotatable bending plate (12) with an eccentric bending mandrel (13) and, located opposite the bending plate (12), a central bending template (14).

8. The installation of claim 7, characterized in that the central bending template (14) retractable from an operating position into a rest position perpendicularly to the longitudinal wire feed path, which clears the movement path of the transverse wire ($Q_1$, $Q_2$) and the transverse wire loops (S, S').

9. The installation of claim 5, characterized in that the bending plate (12) or the bending tool (13) can be retracted from a working position into a rest position which clears the movement path of the transverse wire ($Q_1$, $Q_2$) and the transverse wire loops S, S').

10. The installation of claim 5, characterized in that each loop welding head (18, 19) is displaceable in the longitudinal wire feed direction ($P_1$).

11. The installation of claim 5, characterized in that the transfer were positioning means has clamping jaws which maintain the transverse wires in the loop-bending device (11) during bending and are simultaneously used for transferring the transverse wires (Q, $Q_1$) into the welding device (15).

12. The installation of claims 5, characterized in that each loop welding head (18, 19) can be provided with welding current in accordance with a single or individual spot welding method.

13. The installation of claim 5, characterized in that, when loop welding heads (18, 19) are provided at each wire mesh edge, the oppositely located welding heads can respectively be provided in pairs with welding current in accordance with a double spot welding method.

14. The installation of one of claim 5, characterized in that each loop welding head (18, 19), together with an edge welding head (17), can be provided with welding current in accordance with a double spot welding method.

15. The installation of claim 5, further comprising at least one loop bending device (11) is provided per wire mesh edge.

16. The installation of claim 5, wherein said transverse wire positioning means (10) comprises clamping jaws (10').

17. The installation of claim 5, wherein said transverse wire conveying means comprises means for feeding transverse wires ($Q_1$, $Q_2$), previously cut to length, from a supply transversely across the longitudinal wire feed path of the longitudinal wires.

18. The installation of claim 5, wherein the transverse wire conveying means comprises a device for removing wire material from a reel (V, 5), cutting the wires to length, and conveying the so cut transverse wires ($Q_1$, $Q_2$) crosswise with respect to the longitudinal wire feed path.

19. The installation of claim 5, wherein said welding device comprises welding heads (18*a*, 18*b*) positioned for welding the terminal regions of said end portions (E) of the transverse wires ($Q_1$, $Q_2$) to the end elements (L′) of the longitudinal wires (L, L′).

20. The installation of claim 5, wherein the transverse wires ($Q_1$, $Q_2$) have end portions (E) which project from both sides beyond the end elements (L′) of the longitudinal wires (L, L′), further comprising:

a second bending device for bending into a loop a second end piece of at least one of the transverse wires that extend over a side of a second longitudinal end element, a second resistance welding device that is associated with the second bending device for welding the associated bent loop of the second end piece of transverse wire to at least one of the longitudinal wires and optionally to the second longitudinal end element, and the transverse wire positioning means (10) moving the wire to the bending line, and then downstream to the welding line.

* * * * *